United States Patent [19]

Welch

[11] 4,295,338

[45] Oct. 20, 1981

[54] CRYOGENIC PUMPING APPARATUS WITH REPLACEABLE PUMPING SURFACE ELEMENTS

[75] Inventor: Kimo M. Welch, Mountain View, Calif.

[73] Assignee: Varian Associates, Inc., Palo Alto, Calif.

[21] Appl. No.: 86,107

[22] Filed: Oct. 18, 1979

[51] Int. Cl.[3] ..... B01D 8/00

[52] U.S. Cl. ..... 62/55.5; 62/268; 55/269; 417/901

[58] Field of Search ..... 62/55.5, 100, 268; 55/269; 165/76; 417/901

[56] References Cited

U.S. PATENT DOCUMENTS 2,703,673 3/1955 Winkler ..... 62/55.5

4,121,430 10/1978 Bachler et al. ..... 62/55.5

*Primary Examiner*—Ronald C. Capossela

*Attorney, Agent, or Firm*—Stanley Z. Cole; Leon F. Herbert

[57] ABSTRACT

Two-stage cryogenic pumping apparatus having individual plate members with cryosorbent coatings secured by removable fasteners to permit easy assembly and replacement of the plate members. The plate members are spaced apart to provide relatively unrestricted access to the cryosorbent material for the gases to be adsorbed thereon.

11 Claims, 3 Drawing Figures

CRYOGENIC PUMPING APPARATUS WITH REPLACEABLE PUMPING SURFACE ELEMENTS

This invention pertains generally to cryogenic pumping apparatus and more particularly to a two-stage cryogenic pump in which gases are removed by condensation and/or adsorption on progressively colder pumping surfaces.

In a two-stage cryogenic pump, the first pumping stage is typically maintained at a temperature on the order of 50° K.–80° K., and the second pumping stage is maintained at a colder temperature on the order of 10° K.–20° K. Gases such as water vapor and carbon dioxide are cryopumped by condensation at the higher temperature first stage, whereas gases such as oxygen, nitrogen, argon, helium, hydrogen and neon, which require a lower temperature for condensation or adsorption, are pumped at the second stage.

The second stages of cryogenic pumps heretofore provided commonly employ inverted cup arrays having a cryosorbent material bonded to the inside surfaces thereof. The second stage assemblies are generally welded or brazed together, after which the cryosorbent material is applied. An example of a cryogenic pump having a second stage of this type is found in copending application Ser. No. 930,953, filed Aug. 4, 1978 and assigned to the assignee herein.

With second stages of the type heretofore provided, replacement of the entire second stage assembly is necessary in the event of adsorbent material contamination. Depending upon the design of the stage, the adsorbent material coating may be difficult to apply. Moreover since adsorbent coated surfaces are intended primarily for pumping certain gases such as hydrogen, helium and neon, the second stage should provide ready access to the coated surfaces for these gases while maintaining sufficient shielding from other gases. With an inverted cup assembly, shielding is accompanied by some loss of accessability to the adsorbent material.

It is in general an object of the invention to provide a new and improved cryogenic pumping apparatus.

Another object of the invention is to provide a cryogenic pumping apparatus of the above character in which the pumping surfaces of the second stage are readily replaceable.

Another object of the invention is to provide a cryogenic pumping apparatus of the above character in which the adsorbent-coated surfaces of the second stage are readily accessible to the gaseous species to be adsorbed thereon.

Another object of the invention is to provide a cryogenic pumping apparatus in which the adsorbent-coated surfaces of the second stage may be replaced on the main assembly frame of the second stage at modest expense in the event of contamination.

These and other objects are achieved according to the invention by providing a cryogenic pumping apparatus having a first pumping stage maintained at a first temperature for removing a first portion of gaseous species from a chamber, and a second pumping stage maintained at a temperature lower than the first temperature for removing an additional portion of the gaseous species from the chamber. The second stage comprises a frame and a plurality of individual plate members removably mounted on the frame in a spaced array to form pumping surfaces for the gaseous species. One surface of the plate members is coated with an adsorbent material before the plate members are mounted on the frame, and the plate members are secured to the frame by readily releasable fasteners such as screws.

Figure 1:
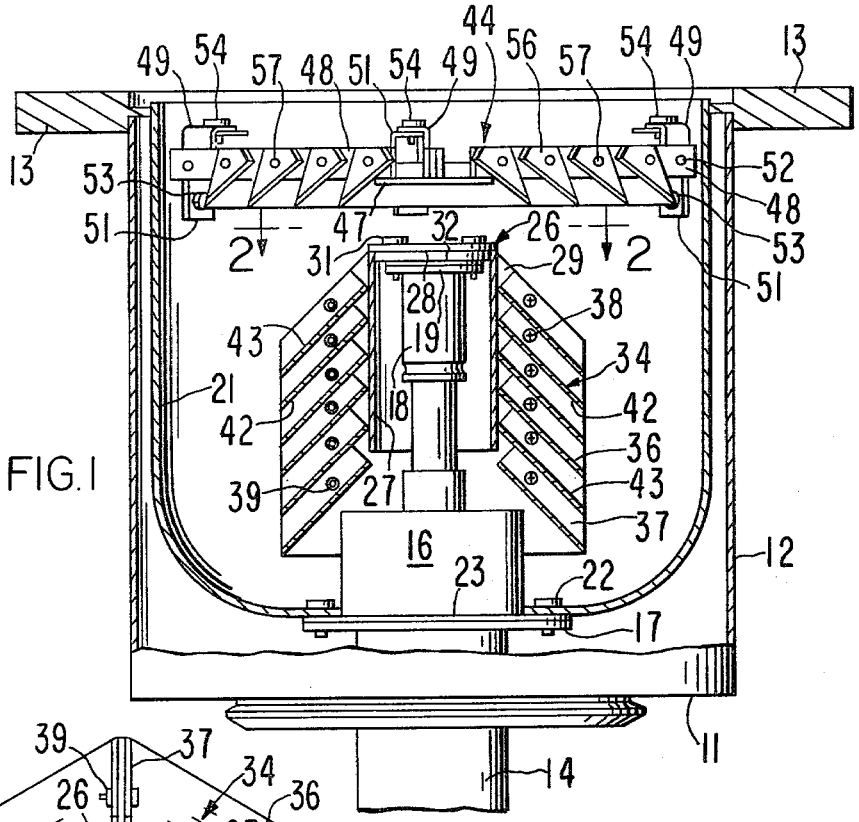
FIG. 1 is a side elevational view, partly broken away and partly schematic, of one embodiment of a cryogenic pumping apparatus according to the invention.
Figure 2:
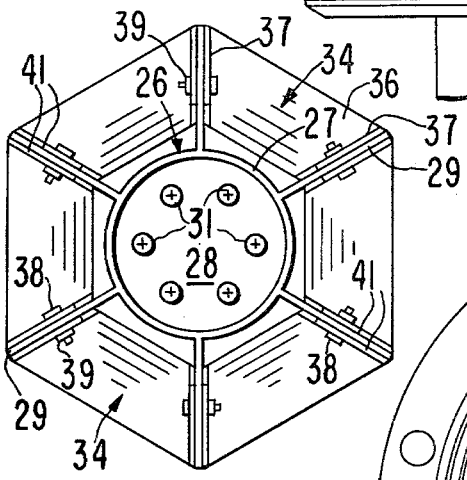
FIG. 2 is an enlarged fragmentary cross sectional view taken along line 2—2 of FIG. 1.
Figure 3:
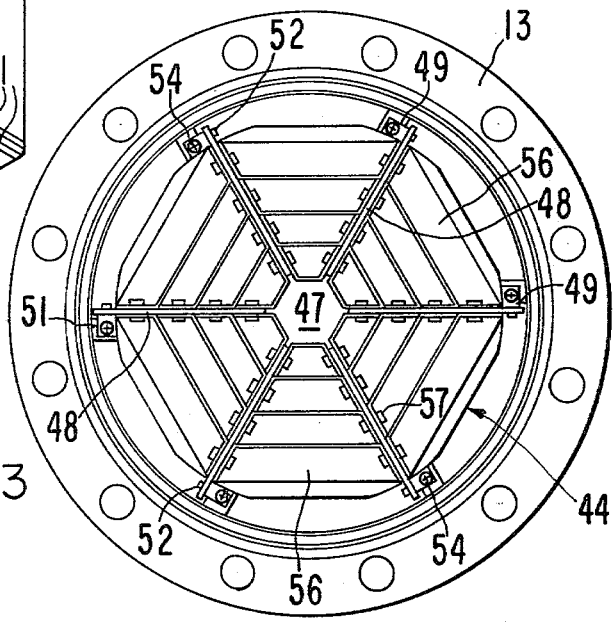
FIG. 3 is a top view of the embodiment of FIG. 1.

As illustrated in the drawings, the pumping apparatus includes a generally circular base 11 on which a generally cylindrical housing 12 is mounted. The housing is open at the top, with an annular flange 13 for attachment to the mating flange of a port in communication with a chamber to be evacuated.

Cooling is provided by a closed-loop refrigeration system in which compressed helium gas is expanded in two successive stages. This system includes a two-stage expander 14 coupled to a remotely located compressor (not shown). The expander includes an elongated first stage 16 having an annular flange 17 toward the upper end thereof, and an elongated second stage 18 having a flange 19 toward the upper end thereof. The first stage is typically maintained at a temperature on the order of 50° K.–80° K., and the second stage is maintained at a temperature on the order of 10° K.–20° K. The expander extends axially through base 11 and is secured thereto and sealed by suitable means (not shown).

The first stage of the pump includes a generally cup-shaped body 21 mounted on expander flange 17 and secured thereto by mounting screws 22. An indium gasket 23 is employed between the pump body and the expander flange to assure intimate thermal contact between the first stages of the expander and the pump. In one presently preferred embodiment, pump body 21 is fabricated of aluminum and formed to the cup shape by a spinning process. The inner surface of pump body 21 is preferably blackened to prevent external thermal radiation from being reflected to the second stage of the pump.

The second stage of the pump includes a frame 26 having an elongated cylindrical core 27, with a circular end plate 28 at the top of the core and a plurality of radial fins 29 extending outwardly and downwardly from the core. In the preferred embodiment, cylindrical core 27 is fabricated of copper, the radial fins are fabricated of a copper-nickel alloy to provide additional strength, and the core and fins are brazed together to form a rigid unitary structure. The frame is mounted on flange 19 at the upper end of the second expander stage and secured thereto by screws 31, with an indium gasket 32 assuring intimate thermal contact between the second stages of the expander and the pump.

The second stage also includes a plurality of individual plate members 34 mounted on frame 26. Each of these plate members includes a generally planar web portion 36, with mounting flanges 37 extending from the web portion at the sides thereof. The plate members are mounted between the fins of the frame, and the web portions of the plate members have a generally trapezoidal shape, with mounting flanges 37 diverging at substantially the same angle as the fins. The plate members are arranged in groups, with the web portions in each group being spaced axially apart and generally parallel to each other. As best seen in FIG. 1, the plate members extend outwardly and downwardly from the core, with an angle of inclination of approximately 45° between the centerlines of the plate members and the axis of the core. In the embodiment illustrated, the frame has six radial fins, and the plate members are arranged in six groups, with six plate members in each group. This embodiment has a convenient hexagonal shape in plan view, but any suitable number of fins and plates can be employed.

The plate members are secured to the radial fins of the frame by readily releasable fasteners such as screws 38 and nuts 39, with indium gaskets 41 between the fins and mounting flanges to assure intimate thermal contact between the fins and the plate members.

Plate members 34 provide the pumping surfaces for the second stage of the pump. In the preferred embodiment, the plate members are fabricated of copper with a coating of cryosorbent material such as activated charcoal or artificial zeolite on the inner or lower surfaces 42 of the plate members. The upper or outer surfaces 43 of the plate members are highly polished, as by nickel plating, to be reflective to radiation.

In the preferred method of manufacture, the coating of cryosorbent material is formed on the inner or lower surfaces of the plate members before the plate members are mounted on the frame. Once the plate members have been coated, they are positioned between the fins and individually secured by screws 38 and nuts 39. The assembled second stage is then placed on the second stage of the expander and secured by screws 31. In the event that the adsorbent material should become contaminated in use or otherwise require replacement, plate members 34 can easily be removed and replaced.

A louvered thermal shield 44 is included in the first stage of the pump and mounted above the second stage to prevent external thermal radiation from falling directly on that stage and yet permit passage of all gas which can only be pumped on the colder second stage. This shield includes a central plate 47 and a plurality of radial arms 48 extending from the plate to the side wall 21 of the first pumping stage. The inner ends of the radial arms are secured to the central plate by brazing, and the outer ends of the arms are secured to the wall by brackets 49, 51. Brackets 49 are affixed to the radial arms by rivets 52 and brazing, and brackets 51 are affixed to the first stage wall 21 by screws 53. The brackets are secured together by screws 54. To provide good thermal intimacy, indium foil is sandwiched between brackets 51 and first stage wall 21 and between brackets 51 and brackets 49. Outwardly and downwardly inclined louvers or baffles 56 extend between adjacent ones of arms 48 in an overlapping pattern so that thermal radiation from the chamber to be evacuated cannot fall directly on the second stage of the pump. The louvers are affixed to the radial arms by rivets 57 and brazing. In the embodiment illustrated, with the hexagonal second stage, the louvered thermal shield has six sections with four louvers in each section, and the surfaces of the shield are blackened to prevent reflection of thermal radiation to the second stage of the pump. Being a part of the first stage 21, the louvered thermal shield 44 is maintained at substantially the same temperature as the remainder of that stage.

Operation and use of the apparatus is as follows. A chamber to be evacuated is connected in gaseous communication with the inlet opening of the pump, and the compressor connected to expander 14 is actuated to maintain the first pumping stage at a temperature on the order of 50° K.–80° K. and the second pumping stage at a temperature on the order of 10° K.–20° K. Gases such as water vapor and carbon dioxide condense on the pumping surface formed by the inner wall of pump body 21 and the louvered thermal shield 44 of the first stage. Gases such as helium, hydrogen and neon have relatively unrestricted access to the cryosorbent coating on the inner or lower surfaces of plate members 34, where they are pumped by adsorption, while gases such as oxygen, nitrogen and argon are pumped on all second stage surfaces by condensation. The louvered thermal shield 44 permits relatively unimpeded flow of gaseous species from the inlet opening to the second stage, while preventing external thermal radiation from falling directly on the second stage.

The invention has a number of important features and advantages. The application of the coating of adsorbent material to the second stage is greatly facilitated by the manner in which the stage is assembled. The coated surfaces and plate members are easily removed for replacement in the event of contamination of the adsorbent material. Furthermore, the spaced arrangement of the plate members provides improved access to the cryosorbent material for gases such as hydrogen, helium and neon.

It is apparent from the foregoing that a new and improved cryogenic pumping apparatus has been provided. While only one presently preferred embodiment has been described in detail, as will be apparent to those familiar with the art, certain changes and modifications can be made without departing from the scope of the invention as defined by the following claims.

What is claimed is:

1. In a cryogenic pumping apparatus having pumping surfaces maintained at a predetermined temperature for condensation and adsorption of gaseous species: a frame having an axially extending core portion and a plurality of fins extending radially from the core portion, a group of axially spaced generally parallel plate members extending outwardly from the core portion between adjacent ones of the fins and inclined at a predetermined angle to the axis of the core portion, a coating of cryosorbent material on one surface of each of the plate members, and removable fasteners securing the plate members to the fins.

2. The apparatus of claim 1 wherein the plate members have generally planar web portions with mounting portions at the sides of the web portions adjacent the radial fins of the frame.

3. The apparatus of claim 1 wherein said one surface of each plate member is the inner surface.

4. In a cryogenic pumping apparatus for removing gaseous species from a chamber: means forming an inlet opening for gaseous communication with the chamber, a first stage extending axially from the inlet opening and having a pumping surface maintained at a first temperature for removing a portion of the gaseous species, and a second stage positioned coaxially within the first stage and having a plurality of pumping surfaces maintained at a temperature lower than the first temperature for removing an additional portion of the gaseous species, said first stage including a louvered thermal shield positioned between the inlet opening and the second stage for preventing thermal radiation from the chamber from falling directly on the pumping surfaces of the second stage while permitting relatively unimpeded flow of gaseous species from the inlet opening to the second stage, said second stage comprising a frame having an axially extending core portion and a plurality of fins extending radially from the core portion, a plurality of axially spaced generally parallel plate members extending outwardly from the core portion and extending away from the inlet opening and extending between adjacent ones of the fins, a coating of cryosorbent material on the inner surface of each of the plate members, and removable fasteners securing the plate members to the fins.

5. In a cryogenic pumping apparatus for removing gaseous species from a chamber: a first pumping stage maintained at a first temperature for removing a portion of the gaseous species, and a second pumping stage maintained at a temperature lower than the first temperature for removing an additional portion of the gaseous species, said second stage comprising a frame having an axially extending core portion and a plurality of fins extending radially from the core portion, and a plurality of individual plate members removably mounted on the frame to form pumping surfaces for the gaseous species, said plate members having a coating of cryosorbent material on one surface thereof and being arrayed in axially spaced groups extending outwardly from the core portion and extending between adjacent ones of the fins.

6. The apparatus of claim 12 wherein the plate members have generally planar web portions with mounting portions at the sides of the web portions adjacent the radial fins of the frame.

7. In a cryogenic pumping apparatus for removing gaseous species from a chamber: a first pumping stage maintained at a first temperature for removing a portion of the gaseous species, and a second pumping stage maintained at a temperature lower than the first temperature for removing an additional portion of the gaseous species, said second stage comprising a frame having an axially extending core portion and a plurality of fins extending radially from the core portion, and a plurality of individual plate members removably mounted on the frame to form pumping surfaces for the gaseous species, said plate members having generally planar web portions with mounting portions at the sides of the web portions adjacent the radial fins of the frame, and said plate members having a coating of cryosorbent material on one surface thereof and being arrayed in axially spaced groups extending outwardly from the core portion and extending between adjacent ones of the fins.

8. In a cryogenic pumping apparatus for removing gaseous species from a chamber: means forming an inlet opening for gaseous communication with the chamber, a first stage extending from the inlet opening and having a pumping surface maintained at a first temperature for removing a portion of the gaseous species, and a second stage positioned within the first stage and maintained at a temperature lower than the first temperature for removing an additional portion of the gaseous species, said first stage including a thermal shield means positioned between the inlet opening and the second stage for preventing thermal radiation from the chamber from falling directly on the second stage while permitting relatively unimpeded flow of gaseous species from the inlet opening to the second stage, said second stage comprising a frame having an axially extending core portion and a plurality of fins extending radially from the core portion, a plurality of individual plate members removably mounted on the frame to form pumping surfaces for the gaseous species, said plate members being axially spaced and generally parallel, and said plate members extending outwardly from the core portion and extending away from the inlet opening and extending between adjacent ones of the fins, a coating of cryosorbent material on one surface of each of the plate members, and removable fasteners securing the plate members to the fins.

9. The apparatus of claim 8 wherein said one surface of each plate member is the inner surface.

10. The apparatus of claim 9 wherein the plate members have generally planar web portions with mounting portions at the sides of the web portions adjacent the radial fins of the frame.

11. The apparatus of claim 8 wherein the plate members have generally planar web portions with mounting portions at the sides of the web portions adjacent the radial fins of the frame.

* * * * *